US006766914B1

(12) United States Patent
Rios

(10) Patent No.: US 6,766,914 B1
(45) Date of Patent: Jul. 27, 2004

(54) MULTIPLE CONFIGURATION DISPLAY

(76) Inventor: Ciro Rios, 15290 SW. 37 Ter., Miami, FL (US) 33185

( * ) Notice: Subject to any disclaimer, the term of this patent is extended or adjusted under 35 U.S.C. 154(b) by 0 days.

(21) Appl. No.: 10/456,813

(22) Filed: Jun. 9, 2003

(51) Int. Cl.[7] ..... A47F 5/06

(52) U.S. Cl. ..... 211/133.4; 211/196; 280/47.19; 280/47.3

(58) Field of Search ..... 211/196, 133.4, 211/126.2, 132.1, 189; 280/79.3, 78, 47.19, 47.3

(56) References Cited

U.S. PATENT DOCUMENTS

| | | | | |
|---|---|---|---|---|
| 2,672,348 A | * | 3/1954 | Scott | |
| 3,522,888 A | * | 8/1970 | Grams et al. | |
| 4,037,851 A | * | 7/1977 | Romero | 280/79.3 |
| 5,443,168 A | * | 8/1995 | Dyment et al. | 280/47.19 X |
| 5,660,404 A | * | 8/1997 | Dilley | 280/47.19 X |
| 6,138,842 A | | 10/2000 | Rios | 211/133.4 |

* cited by examiner

*Primary Examiner*—Robert W. Gibson, Jr.
(74) *Attorney, Agent, or Firm*—J. Sanchelima; A. Bordas

(57) ABSTRACT

A display assembly (10) capable of being converted from a display configuration to a wheelbarrow configuration. Multiple arrangements of sub-assemblies in each of the configurations provide flexibility to a user in setting up these displays. The display assembly (10) includes a base assembly (20) that keeps an elongated supporting assembly (60) in upright position. The elongated supporting assembly (60) comprises four elongated supporting members (61) releasably locked to each other. The base assembly (20) includes at least two cooperating supporting frame members (22) that support at least one tray assembly (80). At least two arm assemblies (40) are perpendicularly mounted to elongated supporting members (60) to support additional tray assemblies (80). Additional trays (80) are supported by the arm assemblies (40). These components are stored and transported by the invention when transformed into a wheelbarrow configuration with wheel assemblies (70) at one end (79) of elongated supporting member (61). An alternate embodiment includes a wheel assembly (90) removably mounted to arm assemblies (40) that provide a stable and substantially upright position in the wheelbarrow configuration.

7 Claims, 9 Drawing Sheets

61
61
10
66
61
61
68
60
84
80
80′
41
41
81
40
80′
62
41
80′
38
25
26
25
20
22
26′
20
22
22
28
20
24
30
28
70
24′
29
24

67
71
92
66
92
90
94
96
84
80
80′
82
68
61
60
81
42′
40
41
44
48
47
48
45
46′
44
44′
80′
41
80
47
82
45
42
42
84
81
44′
42
20
58
62
27′
62
62
27′
30
63
38
22″
22‴
34
32
20
22⁗
27
34
79
30
32′
22′
70
27
32′
28
29
28
29
28

MULTIPLE CONFIGURATION DISPLAY

BACKGROUND OF THE INVENTION

1. Field of the Invention

The present invention relates to a multiple configuration display, and more particularly, to displays with multiple configurations that can be readily mounted and used as a wheelbarrow.

2. Description of the Related Art

Many designs for displays have been designed in the past. None of them, however, include a readily mountable mechanism that can be configured in multiple displays and also converts the display for ready transportation as a wheelbarrow with cargo space capacity. This invention provides a volumetrically efficient solution for the always-changing needs of display configuration depending on space and products to be displayed while responds to the transportation logistics faced by users of point of sale displays, such as salespersons and employees that need to move displays from one location to another.

These displays are frequently transported to and from various shows and retail establishments. With the present invention, a user may utilize the multiple configuration display and transport it in a different configuration. Even the user may configure one through three displays and continue transporting the remaining in the wheelbarrow configuration. This flexibility permits a user to distribute the displays in different areas.

Applicant believes that the closest reference corresponds to U.S. Pat. No. 6,138,842 for a point of sale display issued on Oct. 31, 2000 to Ciro Rios, who is the applicant therein. However, it differs from the present invention because the patented invention can be configured as one display only. The present invention can be used as a versatile display that can be assembled in one through four display configurations that can be used simultaneously.

Rios' patented invention does not permit the use of more than one configuration. The mechanism of the present invention provides, among other things, an elongated supporting assembly that can be disassembled and one or more of its sub-assemblies can perform the display functions. The present invention also features the ability of defining four wheelbarrow configurations so that a user may distribute the displays and set them up in different areas of the establishment.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a multiple configuration display and wheelbarrow that can be readily assembled and disassembled.

It is another object of this invention to provide a display that can be readily converted to a wheelbarrow with cargo capacity to carry all the components of the display.

It is still another object of the present invention to provide a display that can be assembled in multiple configurations and also different wheelbarrow configuration depending on the user's preference to accommodate the physical surrounding and other needs of the user.

It is still another object of the present invention to provide a multiple configuration display that is volumetrically efficient for transportation and storage.

It is yet another object of this invention to provide such an apparatus that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
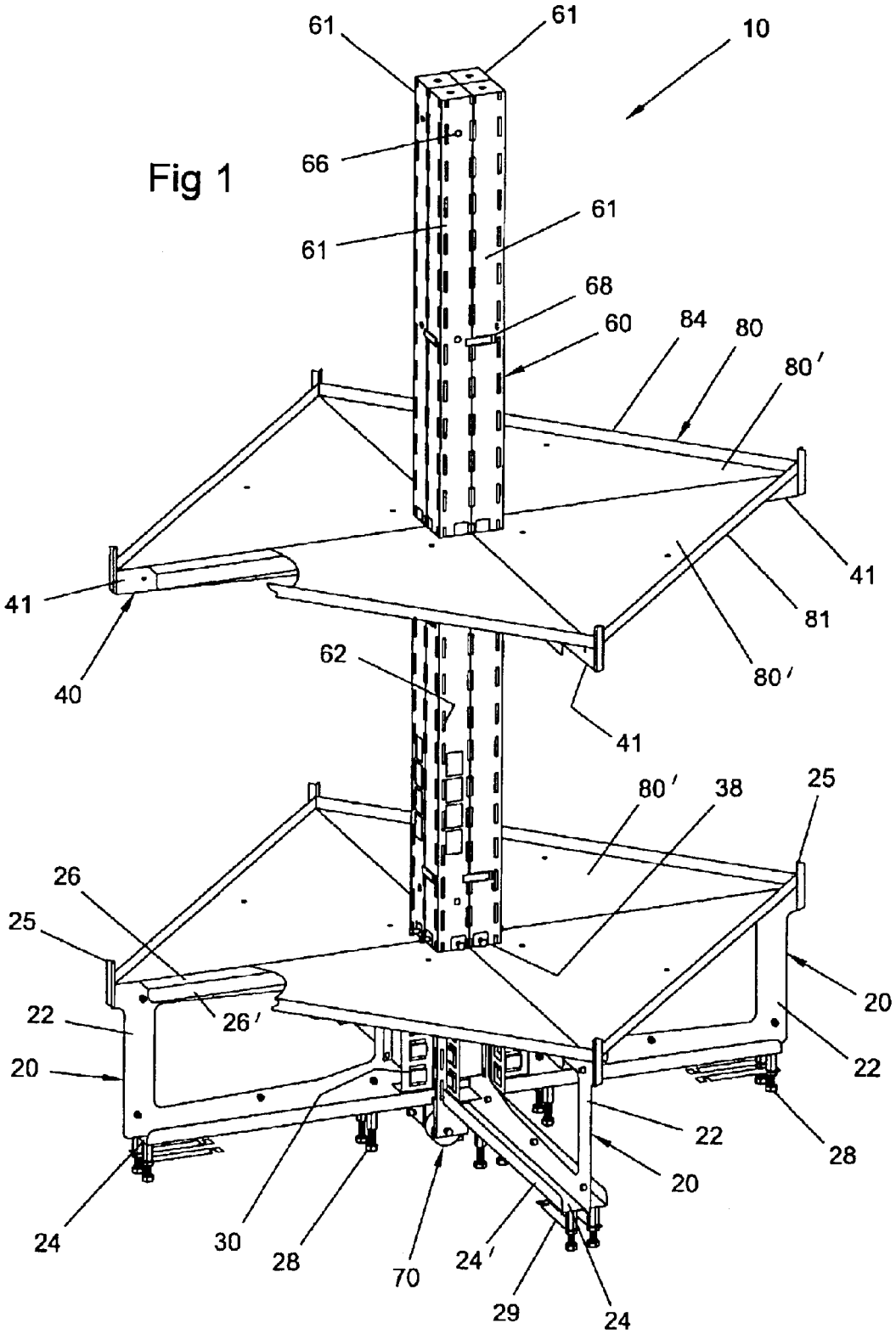
FIG. 1 represents an isometric view of one of the preferred embodiments for the present invention in the point of sale display configuration including four display sub-assemblies.
Figures 2, 3, 3A:
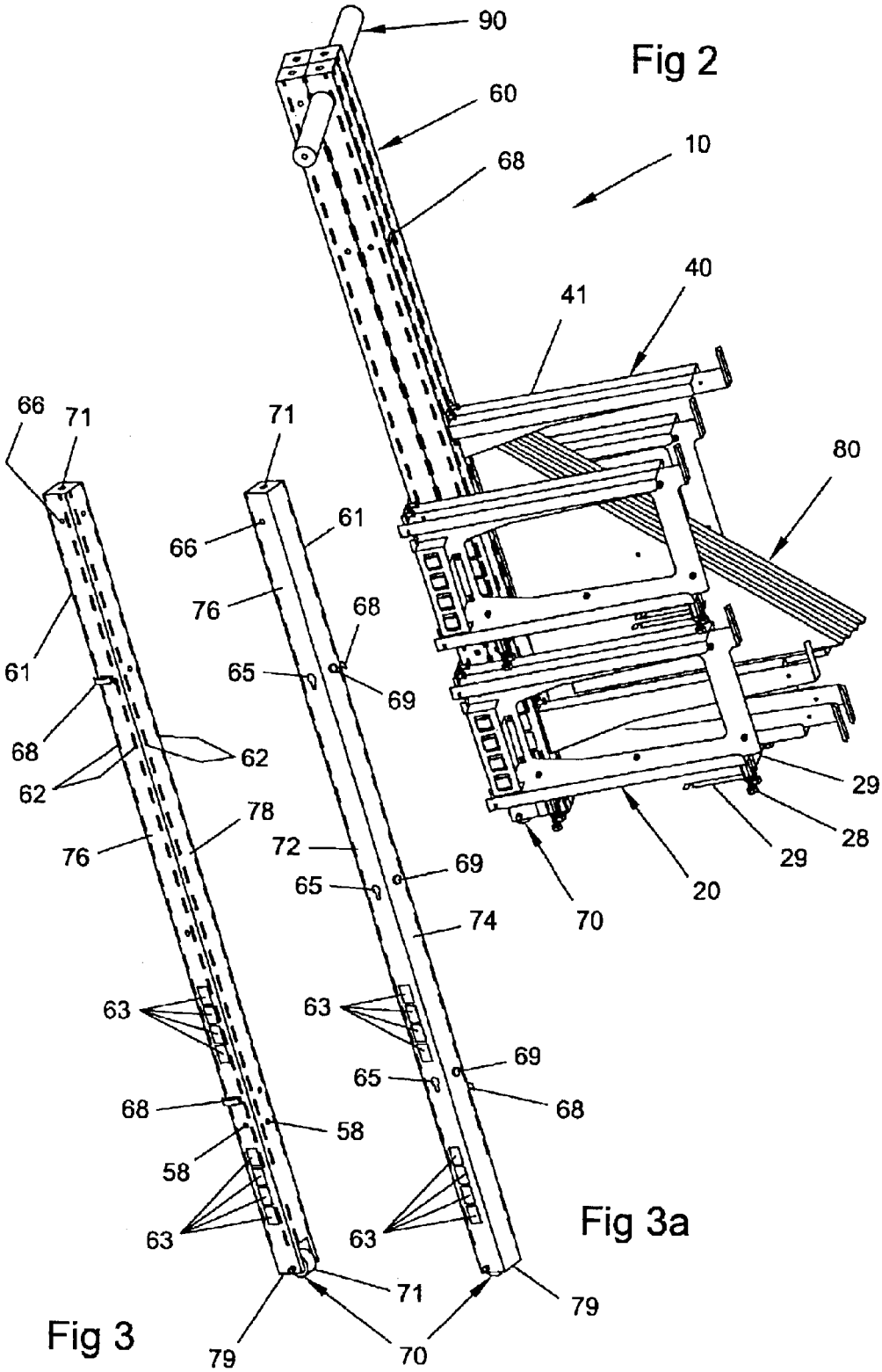
FIG. 2 shows an isometric view of the invention in the wheelbarrow configuration, including the four display sub-assemblies.
FIG. 3 represent an isometric view of one central elongated supporting member showing two of its walls.
FIG. 3*a* represent an isometric view of the central elongated supporting member represented in FIG. 3 showing the two walls opposite to those shown in FIG. 3 shown previously.
Figure 8:
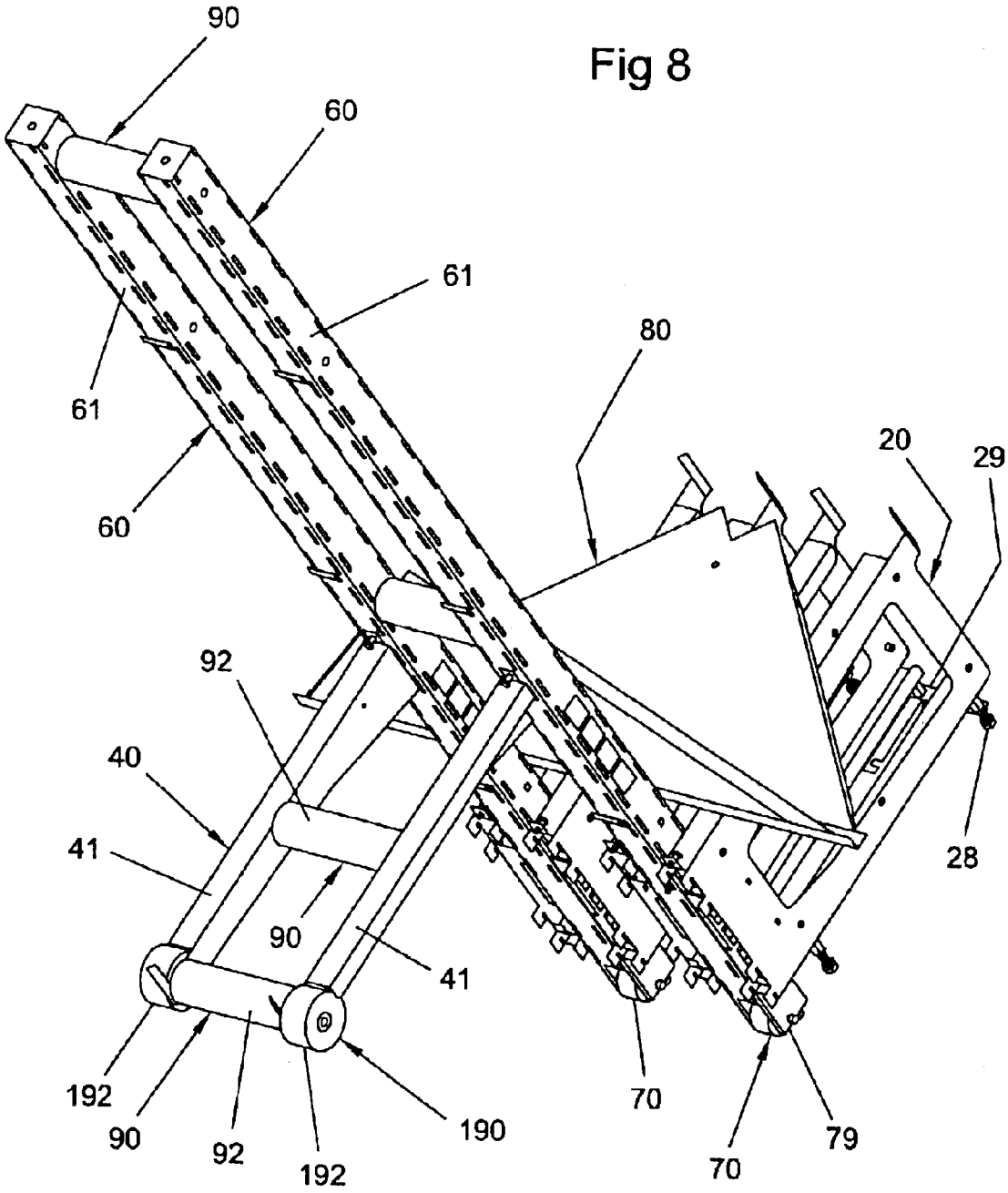
FIG. 8 a front elevational view of another alternative for the wheelbarrow configuration including a wheel assembly.

Referring now to the drawings, where the present invention is generally referred to with numeral 10, it can be observed that it basically includes base assemblies 20, arm assemblies 40, elongated supporting assemblies 60, and tray assemblies 80, as seen in FIGS. 1 and 2. FIG. 1 shows the present invention assembled in the display configuration. FIG. 2 shows the same components assembled in the wheelbarrow configuration. An alternate embodiment including wheel assembly 190 is shown in FIG. 8 using only the minimum two elongated supporting assemblies 60.

Figure 1A:
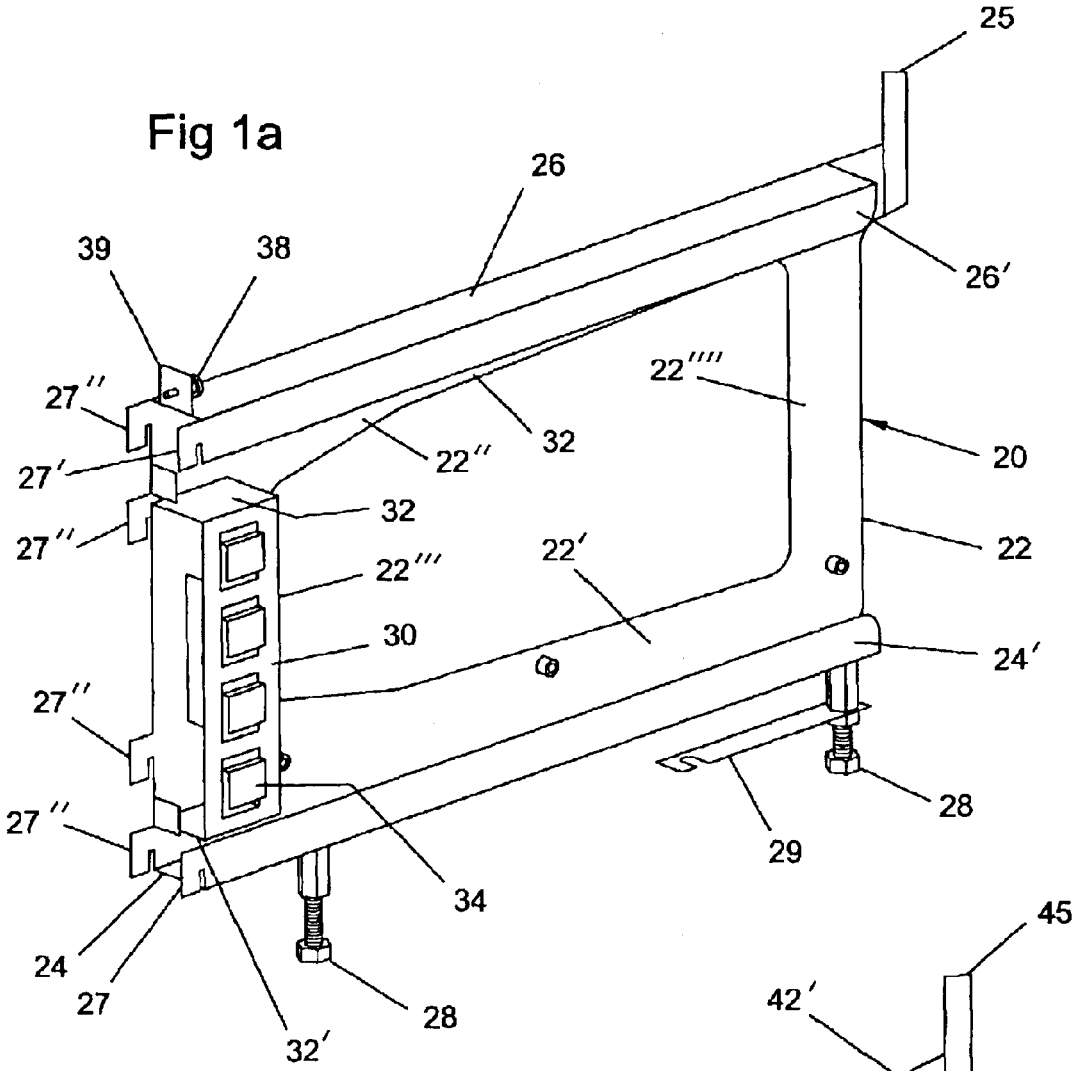
FIG. 1*a* is an isometric view of a base assembly showing the hook terminations.

The display configuration shown in FIG. 1, shows supporting frames 22 extending radially outwardly from elongated supporting assembly 60. Each base assembly 20 includes, in the preferred embodiment two supporting frames 22 perpendicularly mounted to bottom wall 24 and top wall 26, as best seen in FIG. 1*a*. Frames 22 include hook terminations 27" (best seen in FIG. 1*a*) receivable within frame receiving slots 62 (best seen in FIG. 3) to keep frames 22 perpendicularly with respect to assembly 60.

Supporting frame 22 includes frame bottom member 22', frame top member 22", frame front member 22'" and frame rear member 22'", as best seen in FIG. 1*a*. Bottom outer wall 24', is perpendicularly mounted to the lateral edge of bottom wall 24 defining a channel with frame bottom member 22'. Tray stopper end 25 extends from frame rear member 22"" upwardly beyond top member 22". Top outer wall 26' extends perpendicularly from one of the lateral edges of top wall 26 and has substantially the same longitudinal dimension of bottom outer wall 24'. One end of top outer wall 26' includes hook termination 27' in substantial alignment with hook termination 27 that extends from bottom outer wall 24'. Hook terminations 27" extend outwardly from frame front member 22'". Hook terminations 27; 27' and 27" are cooperatively aligned and designed to be removably received within slots 62 to keep frame assembly 20 mounted perpendicularly to assembly 60.

As seen in FIG. 1*a*, base assembly 20 also includes outer engagement wall 30 with spacer walls 32 and 32'. Spacer walls 32 and 32' are positioned at a parallel and spaced apart relationship with respect to each other and perpendicular to the plane of supporting frame 22. Wall 30 extends parallel to front member 22'" and includes hooks 34 on the outer surface for removably engaging square openings 63 (best seen in FIGS. 3 and 3*a*). Adjustable leg members 28 are mounted to the underside of bottom wall 24 to permit the leveling of the display.

Spring loaded locking pin 38 is mounted on plate 39, which is perpendicularly mounted to top wall 26, as seen in FIG. 1*a*. Pin 38 is removably insertable within locking pin receiving opening 58 (best seen in FIG. 3) to keep frame 22 in place.

Figure 1B:
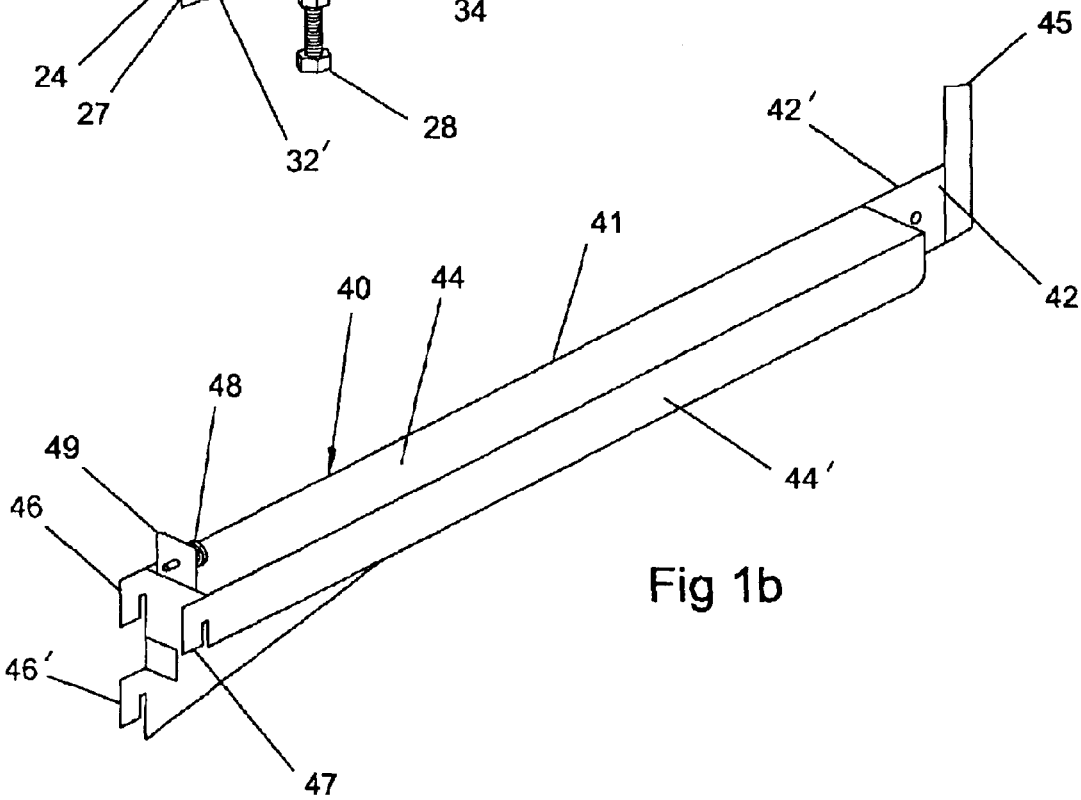
FIG. 1*b* is an isometric view of an arm member showing the hook terminations.

As shown in FIG. 1, arm members 41 extend radially outwardly from elongated supporting assembly 60. Each arm assembly 40 includes, in the preferred embodiment, two arm members 41. As best seen in figure 1*b*, member 41 includes longitudinal wall 42 with longitudinal top edge 42'. Top wall 44 is perpendicularly mounted to top edge 42' and extends longitudinally along the latter. Arm outer wall 44' is mounted perpendicularly to top wall 44 at its longitudinal distal edge and is kept at a parallel and spaced apart relationship with respect to arm wall 42. Arm assembly 40 also includes tray stopper end 45 and hook terminations 46, 46' and 47 with a substantially inverted L-shape. Hook termination 46 and lower hook termination 46' extend at one end of arm wall 42. Hook termination 47 protrudes from the proximal end of arm outer wall 44'. Plate 49 extends perpendicularly and upwardly from one end of top wall 44. Spring loaded locking pin 48 is mounted on plate 49. Pin 48 is removably insertable within locking pin receiving opening 58 to keep arm member 41 in place.

Figure 1C:
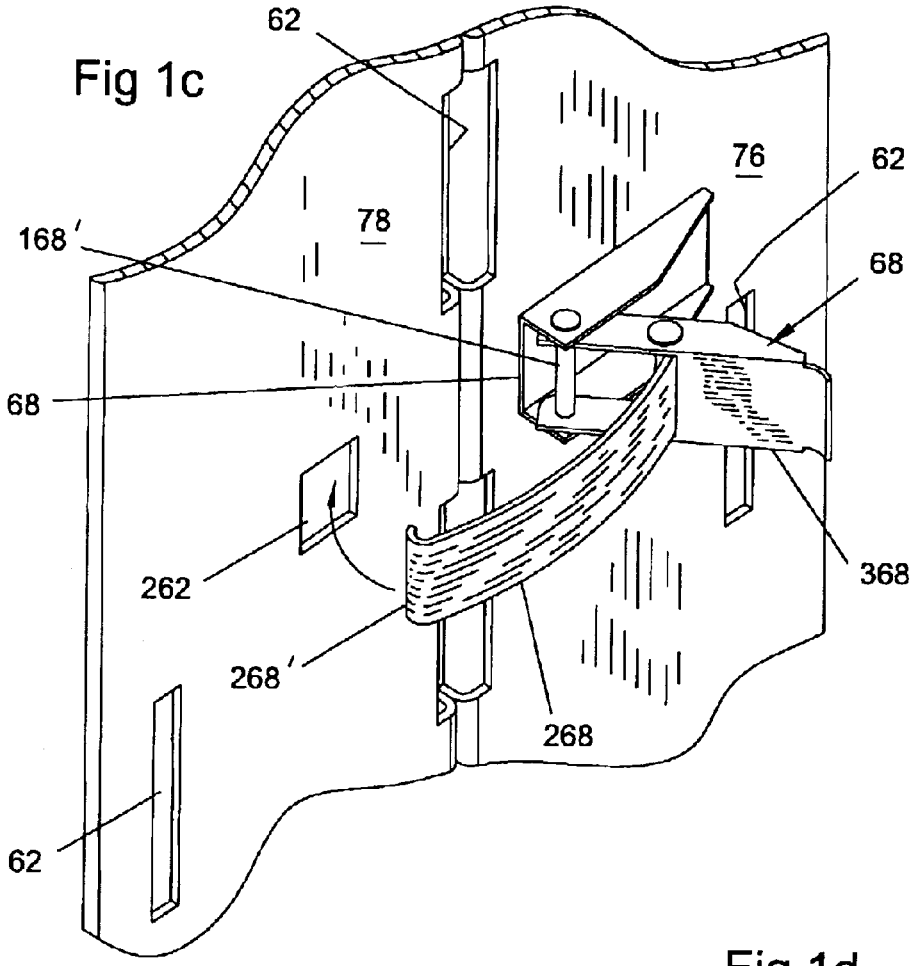
FIG. 1*c* shows an enlarged isometric view of a locking member in the open position mounted to one elongated supporting member.

As seen in FIG. 1, elongated supporting assembly 60 includes, in the preferred embodiment, four elongated supporting members 61. As best seen in FIGS. 3 and 3*a*, each elongated supporting member 61 has an upper end 71 and a lower end 79 with longitudinally extending walls 72, 74, 76 and 78 defining a substantially square cross-section. Members 61 are releasably locked to each other. They can be separated, as required, to build separate displays. As shown in FIG. 1*c*, latch assembly 68 is mounted wall 76 and it comprises base 168 rigidly mounted to wall 76, latch member 268 with hook termination 268' and lever 368. Latch member 268 is hingedly mounted to lever 368, which in turn is hingedly mounted to base 168 through pin 168'. Hook termination 268' is removable received by cooperating slot 262 on wall 78 of an abutting elongated supporting member 61. The user pulls crowbar 368 to completely lock supporting members 61.

Figure 1D:
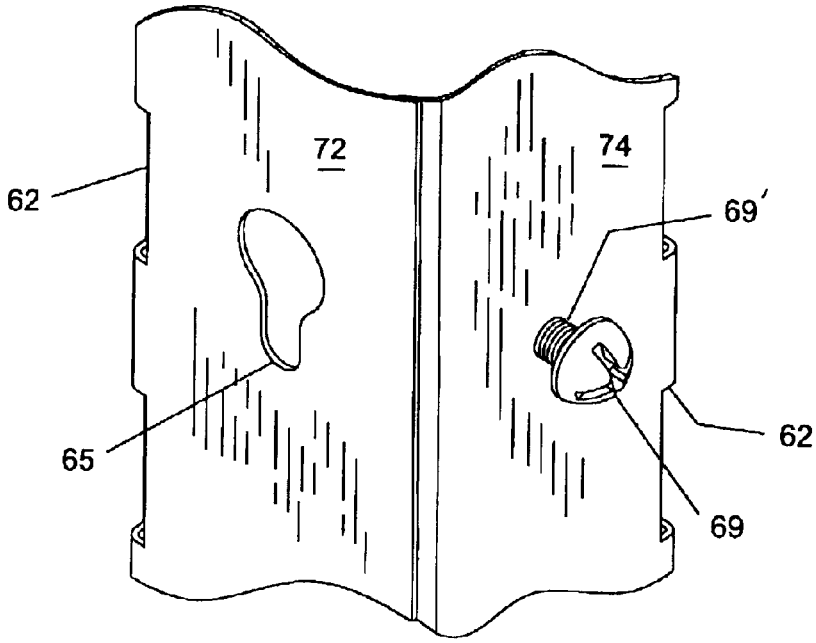
FIG. 1*d* is an enlarged isometric view partially showing two elongated supporting member with a rigidly mounted headed pin and a headed pin receiving opening.

Elongated supporting member 61 also includes frame receiving slots 62, headed pin receiving openings 65, latch assembly 68, headed pins 69 and wheel assembly 70 at end 79. Headed pin receiving opening 65 has a substantially pear-shape with one end narrower than the other end, as seen in FIG. 1*d*. Opening 65 of one supporting member 61 receives headed pin 69 of another member 61 through the wider end. The abutting supporting member are slid to be brought in alignment with shank 69' of headed pin 69 locked with the narrower end of opening 65. Latch assembly 68 releasably keep elongated supporting members 61 in abutting relationship as one unit.

Wheel assembly 70 extends perpendicularly and outwardly from lateral wall 78, as shown in FIG. 3. Assembly 70 includes wheel 71 that protrudes slightly through the plane of wall 78, next to end 79, so that when member 61 is not vertically it rotably supports it, as best seen in FIG. 2.

Figure 7:
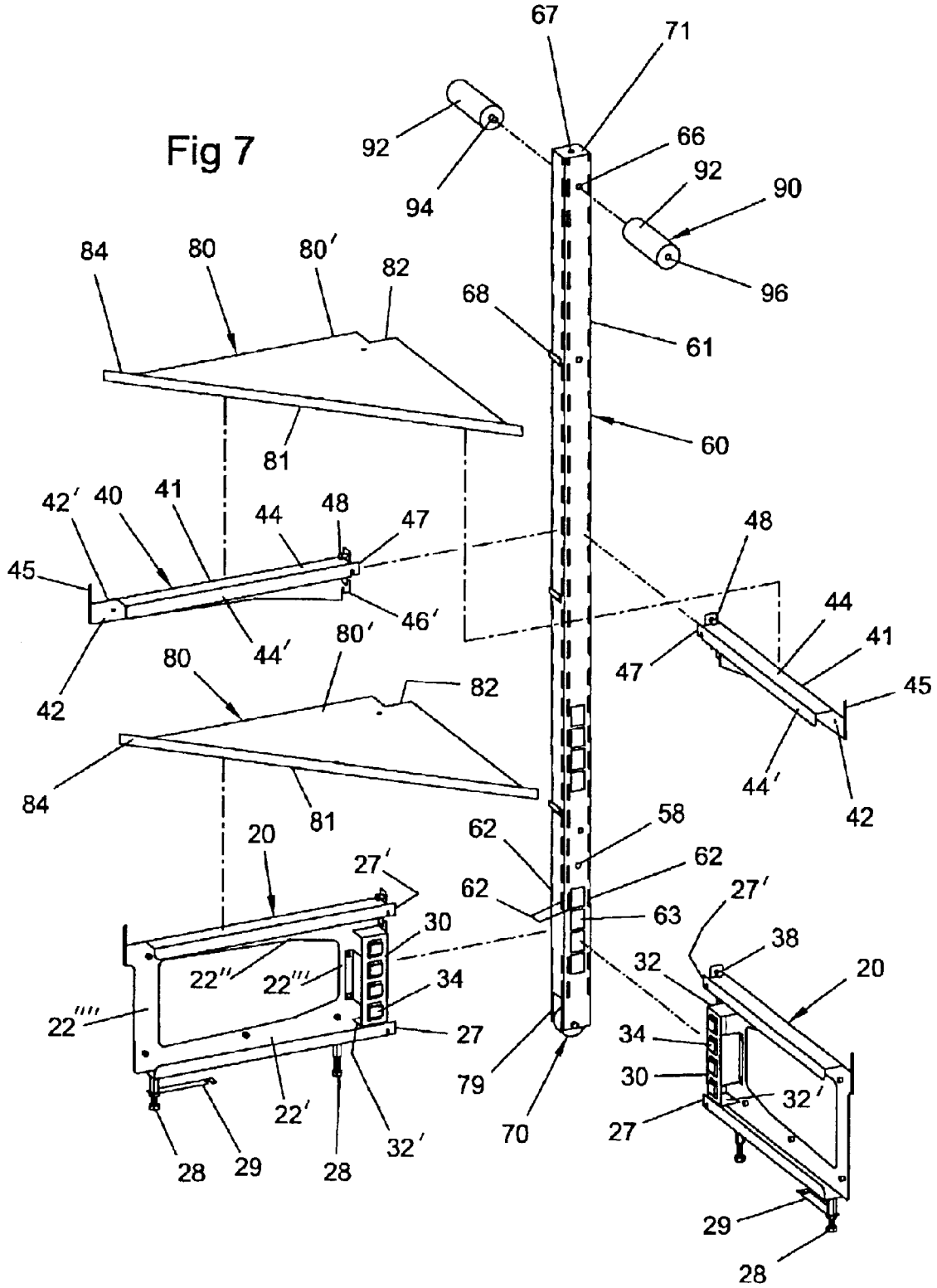
FIG. 7 is an exploded view of one of the four display sub-assemblies.

Each tray assembly 80 includes, in the preferred embodiment, two tray members 80', as represented in figure in FIG. 1. Tray member 80' has a substantially flat portion with a right-angle triangular shape, preferably. As best seen in FIG. 7, cutout 82 at the right angle corner cooperatively conforms to one of the corners of central elongated supporting assembly 60. Tray member 80' also includes flange 84 perpendicularly disposed along the hypotenuse edge 81. Flange 84 prevents displayed items from falling off. Tray assembly 80 is removably mounted to upper wall 26 of base assembly 20 and to top wall 44 of arm assembly 40 for the second level of trays, as shown in the preferred embodiment (FIG. 1).

In one of the wheelbarrow configuration, as shown in FIG. 2, four members 61 are coextensively aligned. Members 61 are locked to each other as described above. Frame members 22 are mounted to lateral walls 72 and 76 and arm members 41 are also mounted to members 61 between members 22. Hooks 34 of frame 22 are removably received within square openings 63 of elongated supporting member 61. The other two members 61 include slots 262 that cooperative receive notches 268' of latch members 268.

Supporting member 29 is hingedly mounted to leg member 28 at the distal end of supporting frame members 22, as best seen in FIG. 1*a*. The distal end of supporting member 29 is cooperatively received by leg member 28 of the other supporting frame member 22. In the wheelbarrow configurations, supporting member 29 keeps frame members 22 at a spaced apart relationship with respect to each other and also supports arm members 41 and tray members 80'.

Figure 4:
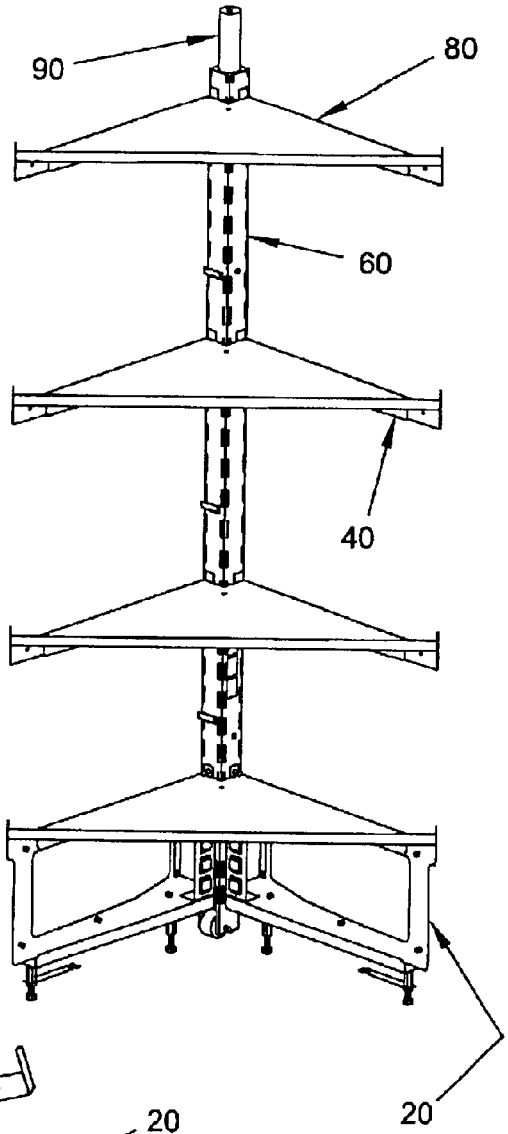
FIG. 4 is a front elevational view of one of the configurations for the present invention including one of the four display sub-assemblies.
Figure 4A:
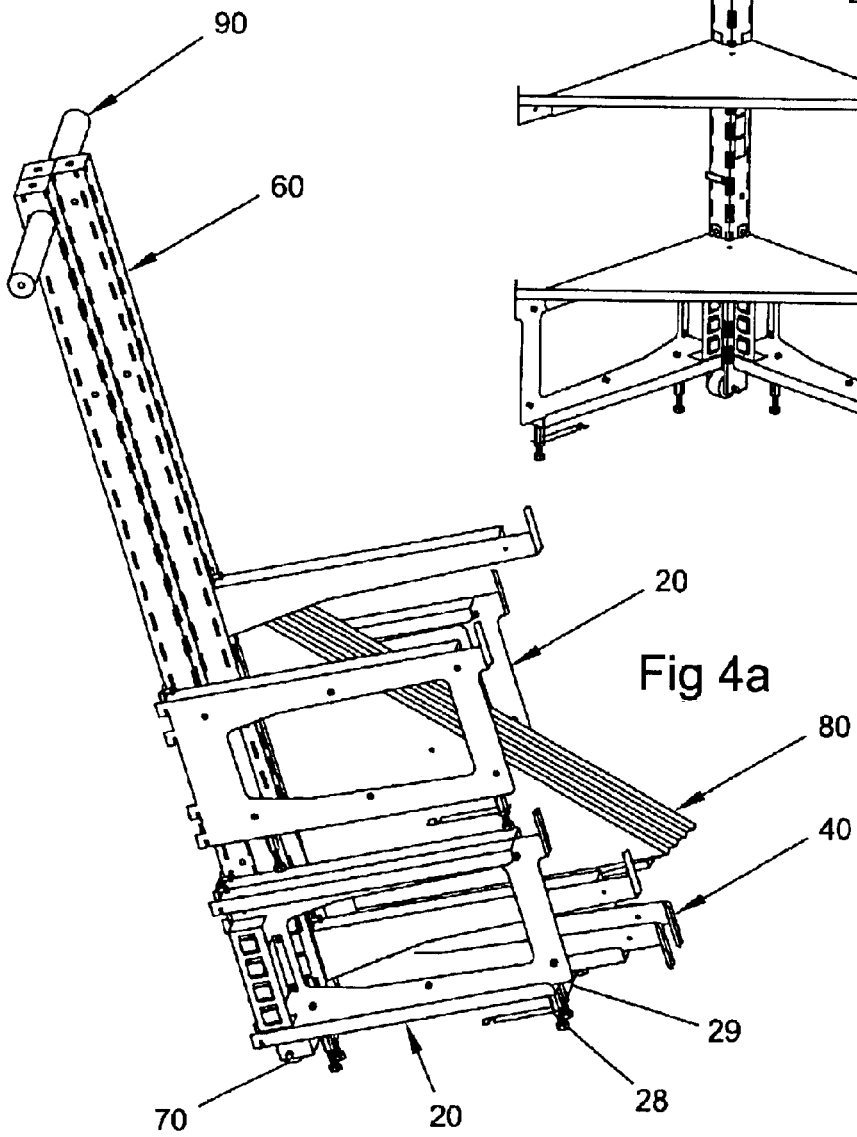
FIG. 4*a* is an isometric view of the wheelbarrow configuration with the parts of the three remaining display sub-assemblies after assembles the display shown in FIG. 4.

Arm members 41 can be also mounted to members 61, as shown in FIGS. 2 and 4*a*.

Figure 5:
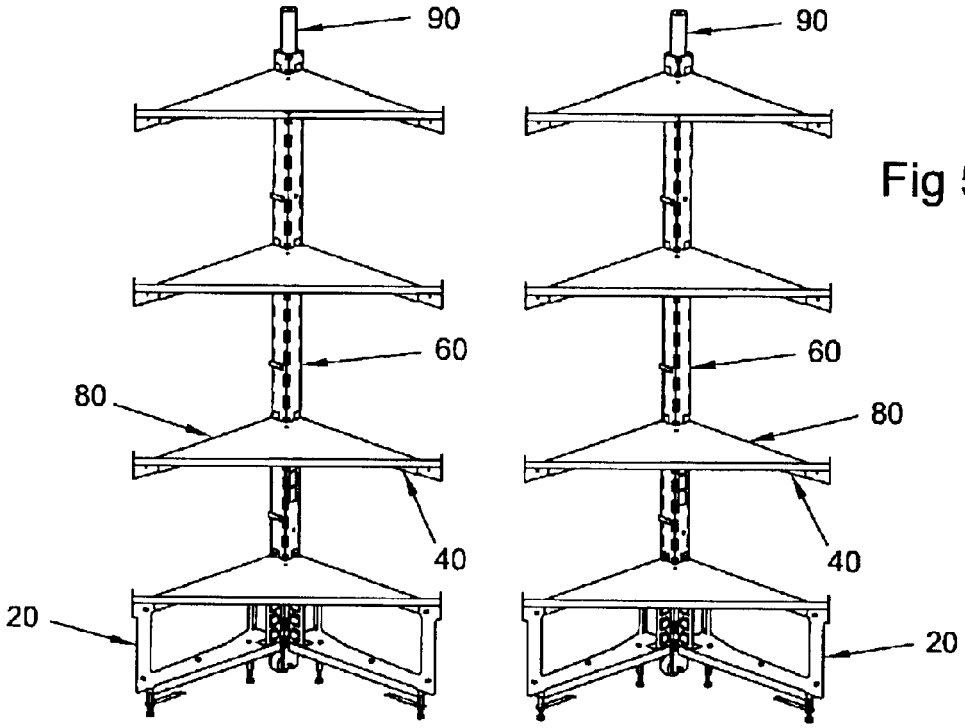
FIG. 5 is a front elevational view of one of the configurations for the present invention including two of the four display sub-assemblies.
Figure 5A:
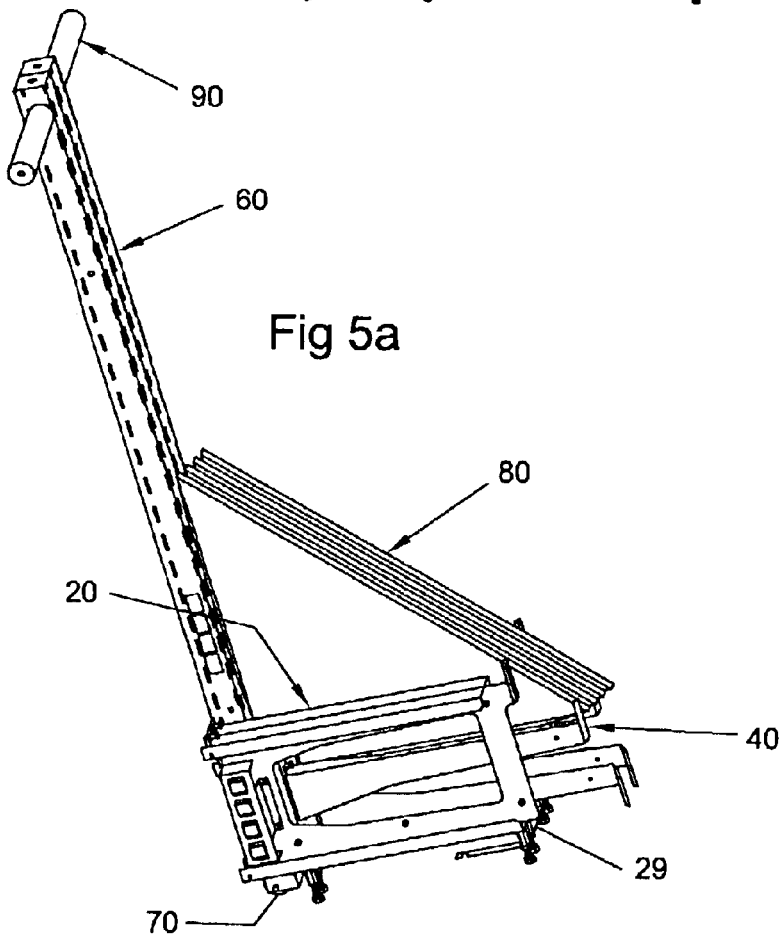
FIG. 5*a* is an isometric view of the wheelbarrow configuration with the parts of the two remaining display sub-assemblies after assembles the displays shown in FIG. 5.
Figure 6:
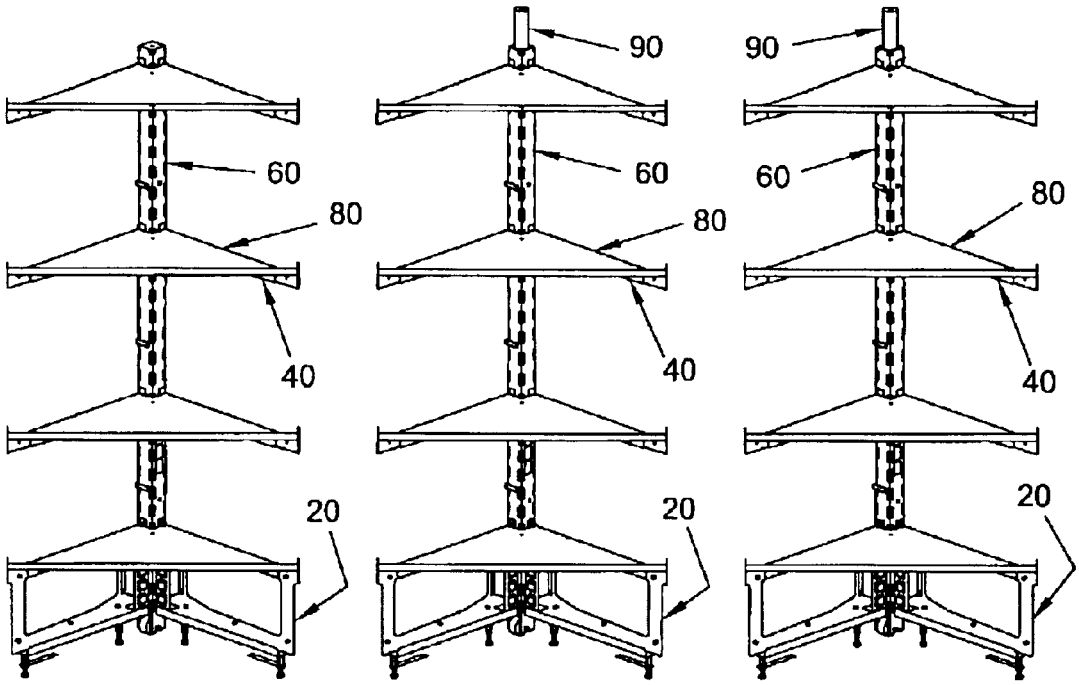
FIG. 6 is a front elevational view of one of the configurations for the present invention including three of the four display sub-assemblies.
Figure 6A:
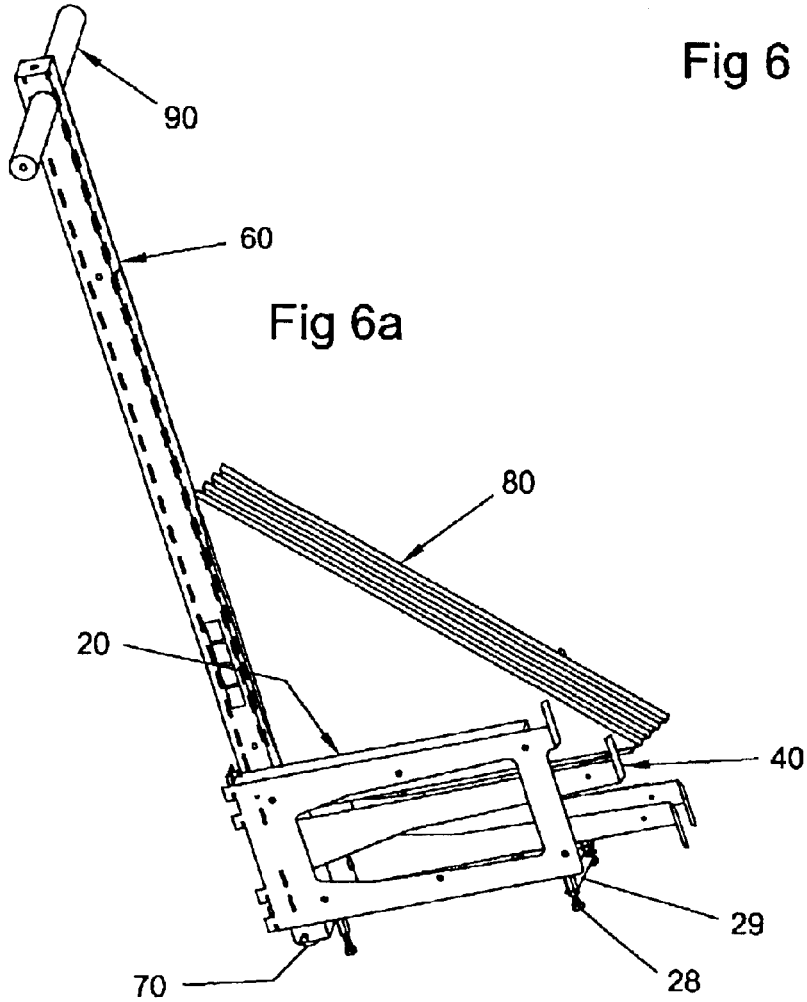
FIG. 6*a* is an isometric view of the wheelbarrow configuration with the parts of the remaining display sub-assembly after assembles the displays shown in FIG. 6.

Handle assemblies 90 are removably mounted to members 61 next to upper ends 71 in the wheelbarrow configurations, as seen in FIGS. 2, 4*a*, 5*a* and 6*a*. Each handle assembly 90 includes two handle portions 92 with threaded pin member 94 at one end and threaded opening 96 at the other end, as best seen in FIG. 7. Threaded pin member 94 is removably mounted to threaded opening 66. In the display configuration, handle portion 92 can be selectively mounted to top opening 67, as seen in FIGS. 4, 5 and 6 to hold advertisement.

In the display configurations, base assembly 20 supports the first level of tray assemblies 80. Arm assembly 40 supports the second and subsequent levels (optional) of tray assemblies 80. When base assembly 20 is mounted to elongated supporting assembly 60, top wall 26 of supporting frame 22 extends outwardly on the same horizontal plane. Top walls 26 and top walls 44 are positioned at a spaced apart and parallel relationship with respect to each other to keep tray assemblies 80 also at a spaced apart and parallel relationship with respect to each other.

Another embodiment for the invention is shown in FIG. 8. Handle assemblies 90 are removably mounted to two elongated supporting members 61, keeping them at a parallel and spaced apart relationship with respect to each other. Two arm members 40 are removably mounted to members 61 at a predetermined distance from lower ends 79 of members 61. Also, handle assemblies 90 are removably mounted to two arm members 40, keeping them at a parallel and spaced apart relationship with respect to each other. Here, wheel assembly 190 is mounted to the distal end of longitudinal wall 42. Two tray members 80' are cooperatively positioned to provide a cargo space area. The resulting configuration for the wheelbarrow configuration is a stable one and stays in a substantially upright position without requiring a surface to lean on.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A point of sale display assembly comprising:

A) an elongated supporting assembly including four coextensive elongated supporting members, each with first and second ends and removably mounted to each other, each of said elongated supporting members including longitudinally extending lateral walls and said first ends including a wheel assembly extending perpendicularly outwardly from one of said lateral walls substantially adjacent to said first ends, and further including locking means for releasably keeping said elongated supporting members in abutting relationship as one unit;

B) a base assembly having at least one pair of supporting frame members and each supporting frame member including means for removably and perpendicularly mounting said at least one pair of supporting frame members to said elongated supporting members adjacent to said first ends in display configuration said at least one pair of supporting frame members being cooperatively disposed to support a flat portion in a substantially horizontal position and said at least one pair of supporting frame members including means for removably mounting said at least one pair of supporting frame members to said elongated supporting members in parallel relationship with respect to each other so that in a wheelbarrow configuration said at least one pair of supporting frame members of each pair can be mounted to said elongated supporting members in a parallel and spaced apart relationship with respect to each other thereby defining a space in between for storage, and each of at least one pair of said supporting frame members further including a supporting member pivotally mounted at the distal end of one of said supporting frame members and removably engaged to the distal end of the other opposite and parallel disposed supporting frame member;

C) at least one first tray assembly removably mounted on said at least one pair of supporting frame members at a predetermined position, said at least one first tray assembly including a flat portion supported by said at least one pair of supporting frame members in the display configuration and said at least one first tray assembly being supported by said supporting members in the wheelbarrow configuration.

2. The point of sale display assembly set forth in claim 1 further including:

D) an arm assembly having at least one pair of arm members and each of said arm members including means for removably and perpendicularly mounting said at least one pair of arm members to at least one of said elongated supporting members at a predetermined distance from said first ends; and E) at least one second tray assembly removably mounted on said at least one pair of arm members.

3. The point of sale display assembly set forth in claim 2 wherein said base assembly includes four pairs of supporting frame members and each of said four pairs of supporting frame members being perpendicularly mounted to each of said four coextensive elongated supporting members thereby forming four separate display structures.

4. The point of sale display assembly set forth in claim 3 wherein said arm assembly includes four pair of arm members and each of said four pairs of arm members being perpendicularly mounted to each of said four coextensive elongated supporting members.

5. The point of sale display assembly set forth in claim 4 having four first and four second tray assemblies mounted to said four pairs of supporting frame members and said four pairs of arm members, respectively.

6. The point of sale display assembly set forth in claim 5 wherein said locking means includes a latch assembly on each of said elongated supporting members and said elongated supporting members include cooperating slots for allowing secure engagement of said latch assembly thereby keeping said elongated supporting members secured against abutting elongated supporting members.

7. The point of sale display assembly set forth in claim 6 wherein said locking means further includes at least one headed pin, on one of said longitudinal wall of each of said elongated supporting members and cooperating pear-shaped openings in each of said elongated supporting members, so that said headed pin can be removably received within said pear-shaped openings.

* * * * *